US005480248A

United States Patent [19]

Tanahashi

[11] Patent Number: 5,480,248

[45] Date of Patent: Jan. 2, 1996

[54] CARRYING HANDLE

[75] Inventor: Naokazu Tanahashi, Nagoya, Japan

[73] Assignee: Brother Kogyo Kabushiki Kaisha, Nagoya, Japan

[21] Appl. No.: 350,038

[22] Filed: Nov. 29, 1994

[30] Foreign Application Priority Data

Dec. 27, 1993 [JP] Japan ..... 5-331529

[51] Int. Cl.[6] ..... B41J 29/02

[52] U.S. Cl. ..... 400/693; 400/691

[58] Field of Search ..... 400/693, 691, 400/679, 719; 190/115, 117, 121, 118, 122, 100, 900; 312/208.4, 208.3, 244; 206/320; 364/708.1; 16/124, 110 R; D8/313, 114; 294/137, 140, 158

[56] References Cited

U.S. PATENT DOCUMENTS

| | | | |
|---|---|---|---|
| D. 342,203 | 12/1993 | Lougee | D 8/313 |
| 2,793,386 | 5/1957 | Muhlhauser | D 8/313 |
| 3,861,556 | 1/1975 | Barecki et al. | 312/244 |
| 3,957,141 | 5/1976 | Domes | 190/901 |
| 4,773,536 | 9/1988 | Rau | 206/379 |
| 4,895,231 | 1/1990 | Yamaguchi et al. | 400/691 |
| 4,951,241 | 8/1990 | Hosoi et al. | 364/708 |
| 4,959,887 | 10/1990 | Gruenberg et al. | 364/708.1 |

*Primary Examiner*—Ren Yan
*Assistant Examiner*—Anthony Nguyen
*Attorney, Agent, or Firm*—Oliff & Berridge

[57] ABSTRACT

A carrying handle includes an opening section provided in the vicinity for electronic equipment of a front face nearly at a central part, in a width-wise direction, of the bottom of a body casing of the equipment. A rib wall extends from the rear side of an open edge of the opening section towards the back side of the keyboard in the body casing, and extends towards the front of the body casing, to cover the opening. A partition wall protrudes from the bottom of the lower cover in the body casing, to enclose a part before the rib wall. A handle section within the front side of the open edge of the opening extends as a circular arc in cross-section into the body. Preferably, these components are molded of a plastic material in one body.

18 Claims, 6 Drawing Sheets

CARRYING HANDLE

BACKGROUND OF THE INVENTION

1. Field of the Invention

The present invention relates to carrying handles, and more particularly, to carrying handles to be grasped for carrying electronic equipment such as a portable printer, a typewriter or other such devices.

2. Description of Related Art

Prior art electronic equipment to be used primarily on a desk, such as a typewriter, a desk-top computer, a portable printer and other such devices, is provided with a handle so that the equipment may be carried with one hand during transport.

The handle is, for example, a handle member 50 (FIG. 5), which is a U-shaped bar separately produced and mounted on the back of a body cover 40 of an electronic typewriter. As shown in FIG. 6, handle member 50 is rotatable through 180 degrees so that the handle can be turned between a stowage position in which a grip portion 51 of the handle member 50 is directed towards the back of the body cover 40, and a usage position in which the grip portion 51 is directed towards the front. A user turns the handle member 50 around to the usage position in which the grip portion 51 protrudes out of the body, and can easily carry the typewriter, grasping the handle member 50.

The handle member 50 of the prior art electronic typewriter, however, being a separate part, must be formed separately at the time of manufacture of the electronic typewriter. Furthermore, installation of the handle on the electronic typewriter and other work must occur. Furthermore, it is necessary to form a depression, equal in depth to the thickness of the handle member 50, in the bottom of the body cover 40 so that the bottom of the electronic typewriter will not be raised at the front with the handle member 50 stowed in the stowage position.

The foregoing considerations create labor and cost problems in connection with the formation and installation of the body cover 40 and the handle member 50.

SUMMARY OF THE INVENTION

It is an object of the present invention to provide a carrying handle that can be formed easily and at a low cost, and that will not interfere with the use of the equipment on which the carrying handle is installed, by utilizing an opening provided in a part of a body casing of the equipment.

To accomplish the above-described and other objects, a carrying handle according to embodiments of the present invention is designed for use in electronic equipment in which a keyboard for inputting characters and symbols is arranged at the front side of a body cover and a printing device is provided at the rear thereof. An opening section is molded integrally in the bottom surface of the body cover, preferably at the front side and nearly at the center of the bottom surface. A rib wall is provided in a preferably curved shape to cover the opening section, extending from the back face of an open edge of the opening section towards the back of the keyboard inside of the body cover and towards the front section of the body cover. A partition wall extends from the bottom surface inside of the body cover to enclose the front side of the interior ahead of the rib wall. A handle in the cross-sectional form of a circular arc extends into the body at the front face side of the open edge of the opening section. With the carrying handle according to embodiments of the present invention, the handle at the opening section may be provided in the form of circular arc along its width, and also the body cover may be provided with a recess-shaped finger slot on the partition-wall side of the handle.

A carrying handle according to embodiments of the present invention, having an opening section nearly at the center in the width-wise direction of the bottom surface of the body cover, allows the user's fingers to extend past the bottom surface and into the interior of the cover. Since the rib wall extends from one side of the open edge of the opening section to cover the opening section, the user's fingers, when inserted into the opening section, are smoothly guided from the other side of the open edge of the opening section towards the front interior of the body cover. Furthermore, the partition wall, extending into the interior and provided at a specific distance from the other side of the open edge, restrains further advance of the user's fingers into the body, thereby preventing the user's fingers from touching any electronic device in the body of the equipment. Furthermore, the rib wall and the partition wall enclose the interior of the body cover and the back side of the keyboard fills up an upper gap between two walls, thereby preventing entrance of foreign substances into electronic devices in the equipment body. Also, because the handle is located on the other side of the open edge, the circular arc provided at the cross section of the handle fits the user's fingers well when the electronic equipment is carried by hand. The handle contacts the user's fingers along a circumferential surface of a specific width, thereby preventing the weight of the electronic equipment from being concentrated at one point. The electronic equipment, therefore, easily can be carried by the user's fingers.

As is clear from the above explanation, a carrying handle according to embodiments of the present invention is composed of an opening section, a rib wall, a partition wall and a handle, which are formed integrally with the body cover. It is, therefore, possible to provide a low-cost carrying handle of simple configuration, which requires little space. Further, the rib wall and the partition wall form projections and depressions in the body cover, which serve to impart greater rigidity in order to resist distortion and deflection of the body cover. In other words, without the rib wall and the partition wall formed in the body cover, the body cover would not resist distortion and deflection as well. Still further, because the carrying handle is located nearly at the center in the width-wise direction of the front of the cover, the electronic equipment can be carried by one hand easily and in a well-balanced state. From the opening section towards the interior of the front part is defined one space enclosed by the rib wall, the partition wall and the back face of the keyboard, thereby preventing entrance of dust and dirt into, and the contact of the user's fingers with, the electronic control circuitry in the body.

BRIEF DESCRIPTION OF THE DRAWINGS

Preferred embodiments of the present invention will be described in detail with reference to the following figures, wherein.

DETAILED DESCRIPTION OF PREFERRED EMBODIMENTS

Preferred embodiments of a carrying handle according to the present invention will be explained with reference to the accompanying drawings. FIGS. 1 to 4 show a carrying handle embodiment according to the present invention used in an electronic typewriter 1. For each of FIGS. 1–4, the front face side of the electronic typewriter is illustrated at the upper part of the figure, while the back face side of the typewriter is illustrated at the lower part of the figure.

Figure 1:
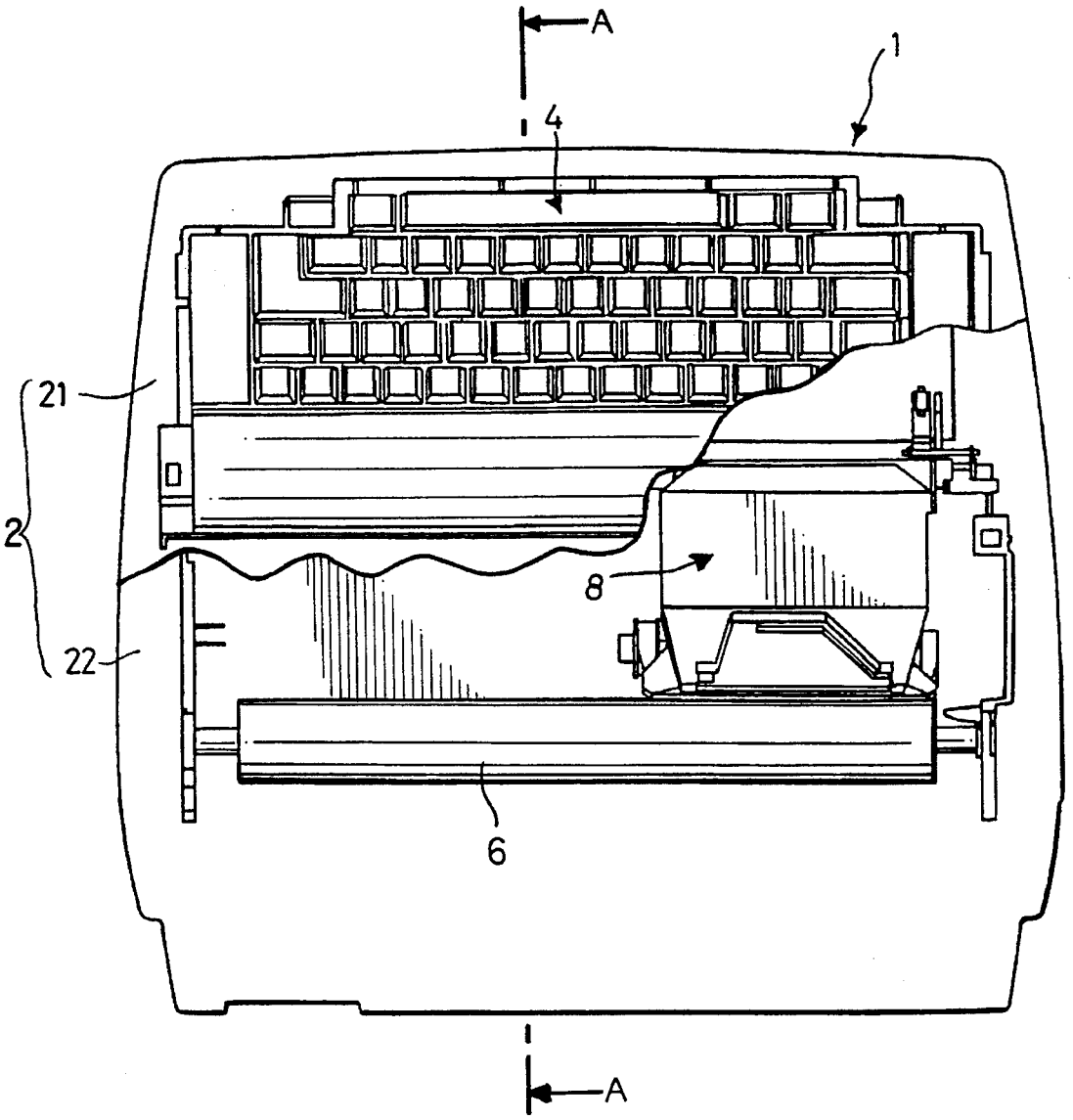
FIG. 1 is a partially broken away view generally showing an electronic typewriter according to a preferred embodiment of the present invention.

First, as shown in FIG. 1, the electronic typewriter 1 has a substantially trapezoidal upper surface and comprises a flat body casing 2, a keyboard 4 for inputting characters and commands for operation provided in the front face of the body casing 2, a platen 6 by which printing paper is fed, and a print head 8 for printing characters and graphics characters on printing paper, loaded by the platen 6, while moving in parallel along the platen 6. Within the body casing 2 are a stepping motor, not shown, for driving the print head 8, and an electronic control circuit, not shown. The electronic control circuit controls a matrix switch, not shown, which is provided under the keyboard 4 for detecting operation of the keyboard 4, and controls the platen 6, the print head 8, and other members of the electronic typewriter 1.

The body casing 2 includes a cover including an upper surface section 21 of the body cover, a lower surface section 22 of the body cover, a cassette replacement cover, and a side cover. The body casing 2 is of a wedge shape, tapering in cross-section towards the front, as shown in FIG. 2.

The upper surface of the front section of the body casing 2 supports the keyboard 4 at an incline corresponding to the wedge-shaped inclination of the casing 2. The keys of the keyboard are mounted on a switch base plate of the matrix switch. The back side of the switch base plate is affixed to a reinforcing board 41 to increase the rigidity of the keyboard.

Figure 2:
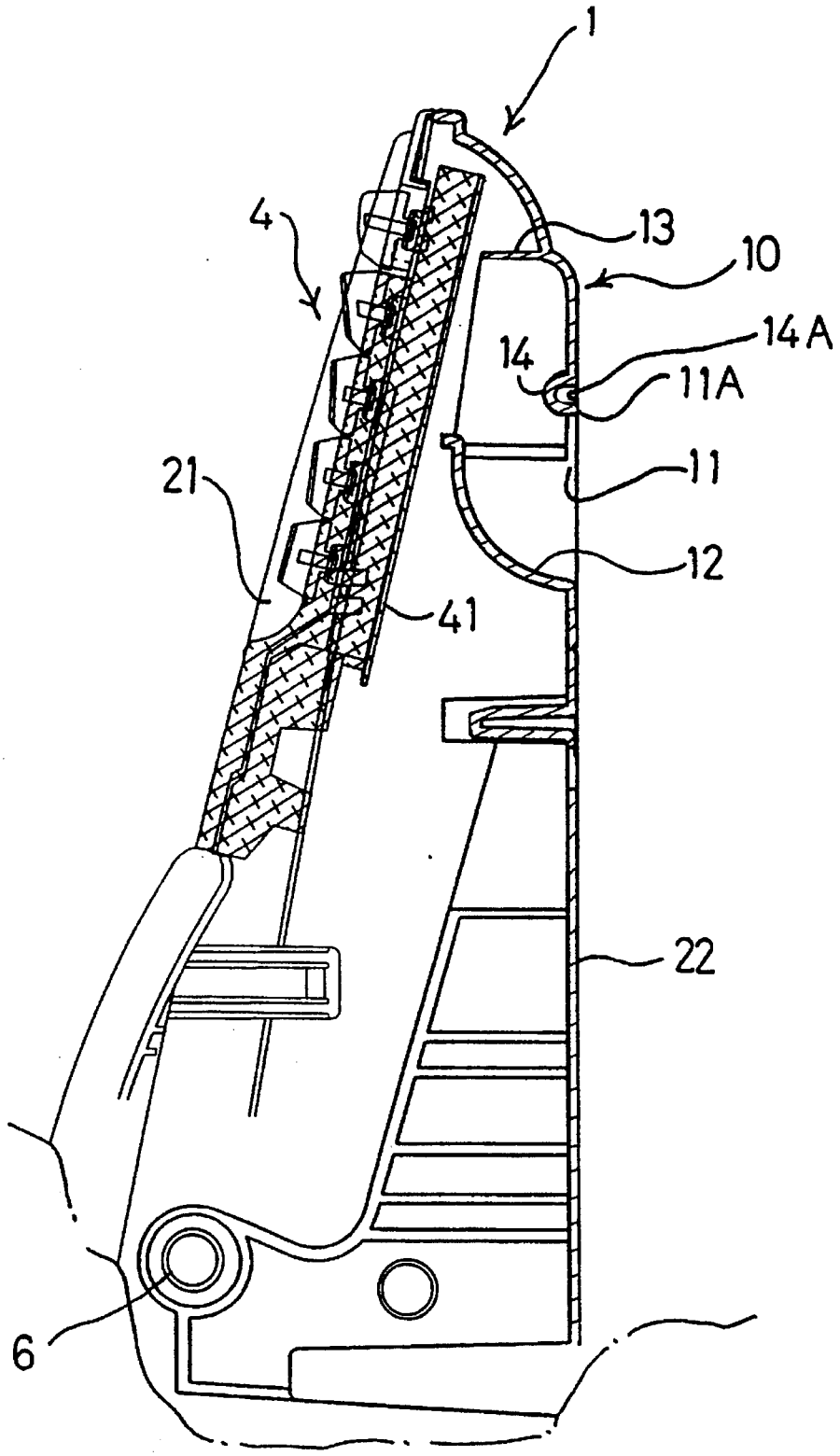
FIG. 2 is a cross-sectional view of the FIG. 1 electronic typewriter taken along line A—A of FIG. 1.
Figure 3:
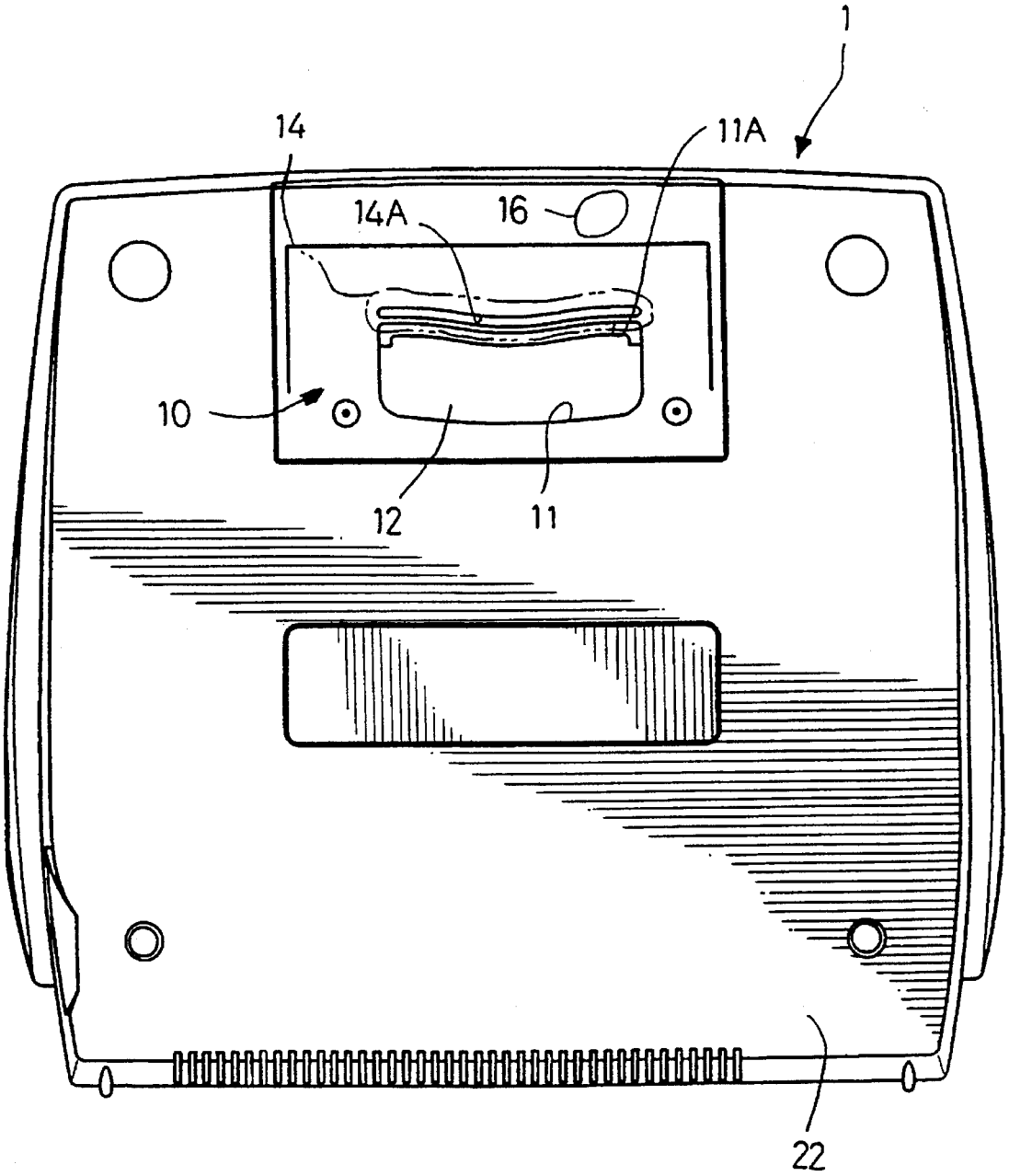
FIG. 3 is a rear view of an electronic typewriter according to an embodiment of the present invention.
Figure 4:
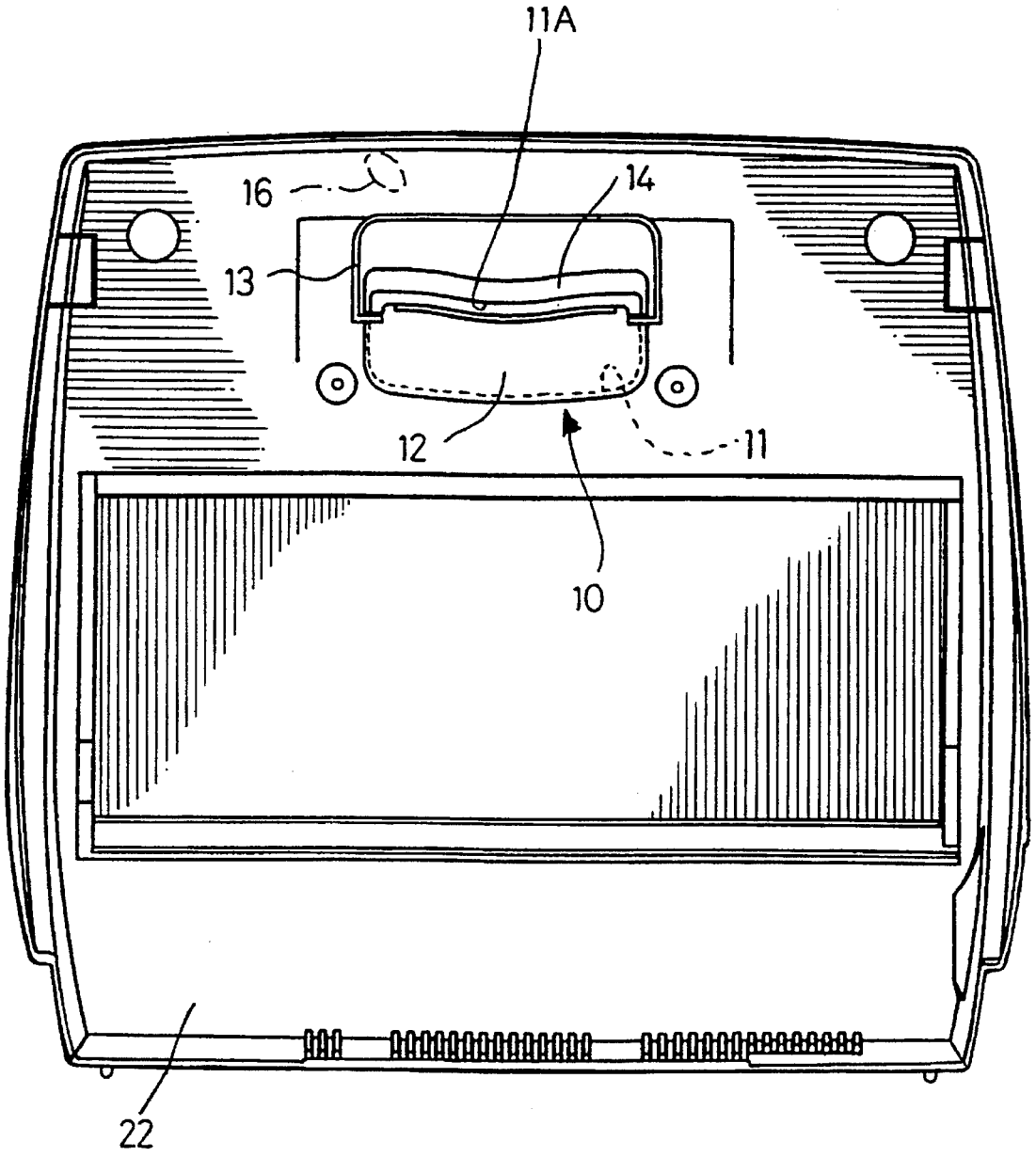
FIG. 4 is a top view of a lower cover of the electronic typewriter according to one embodiment of the present invention.
Figure 5:
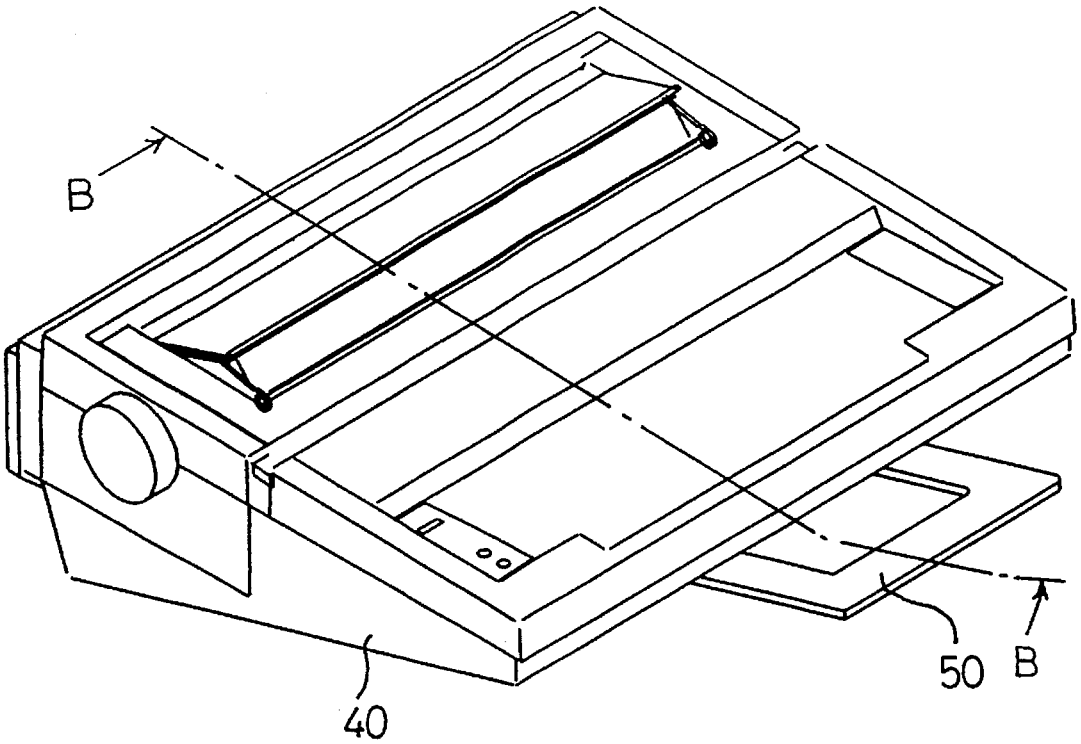
Fig.5 PRIOR ART
FIG. 5 is a perspective view of a prior art electronic typewriter having a separate carrying handle.
Figure 6:
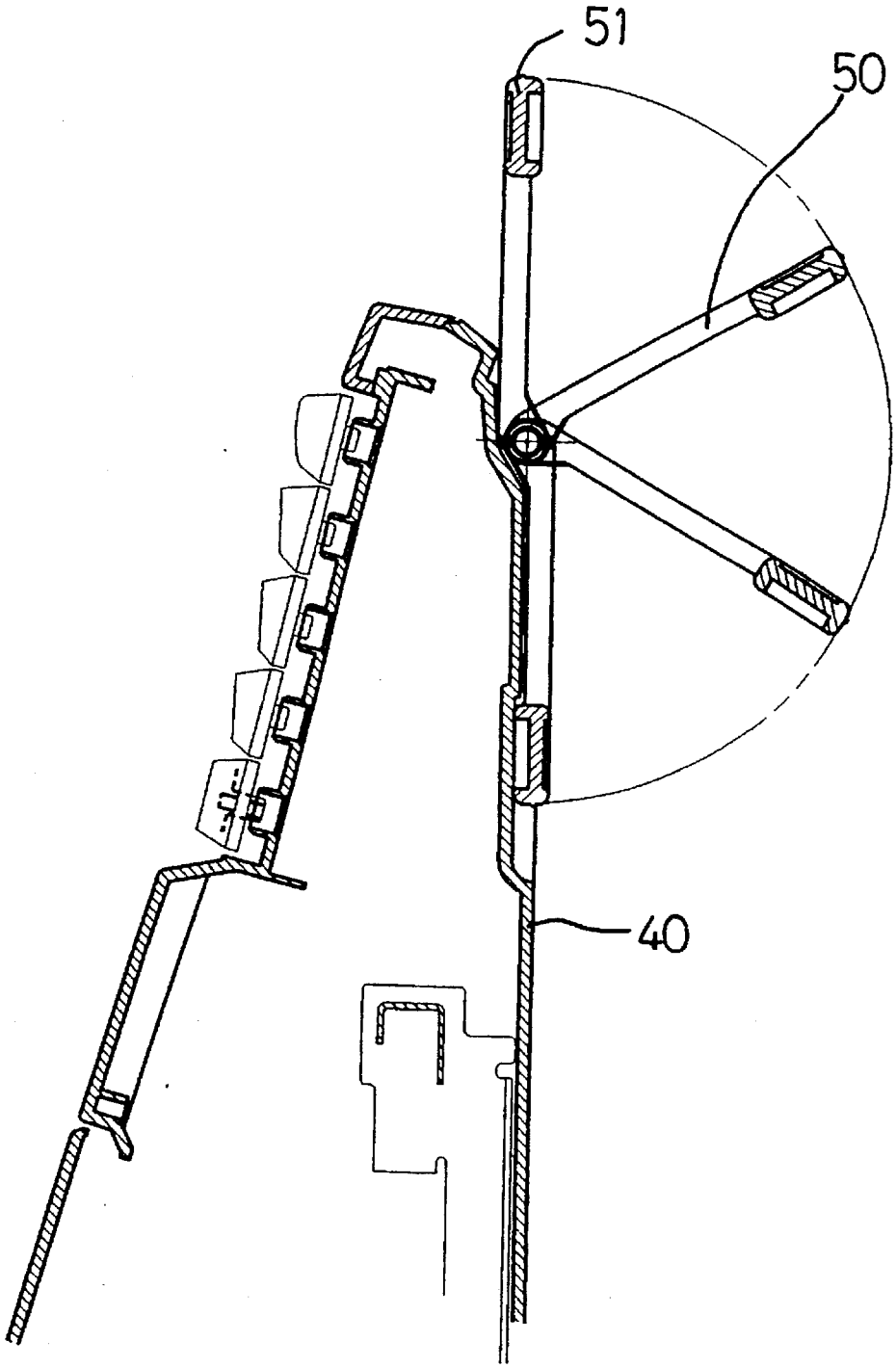
Fig.6 PRIOR ART
FIG. 6 is a cross-sectional view of the prior art electronic typewriter taken along line B—B of FIG. 5.

In the lower surface 22 of the body cover (hereinafter referred to as the lower cover) of the electronic typewriter 1, as shown in FIGS. 2–4, a carrying handle 10 is provided for holding the typewriter 1. The carrying handle 10 has an opening section 11 of nearly rectangular shape, at the central part of and in the front section of the lower cover 22.

A rib wall 12 extends in a curved shape from the back side of an open bottom edge of the opening section 11 towards the back side of the keyboard 4 in the body cover, and gradually bends towards the front side of the typewriter 1. The forward end of the rib wall 12 extends toward the front section of the body casing 2 along the back side of the keyboard 4. Nearly the entire upper part of the interior of the opening section 11 is covered with, that is, bordered by, the rib wall 12. The rib wall 12, as shown in cross-section in FIG. 2, extends from underneath an upper section of keyboard 4 toward a lower section of keyboard 4, to about the middle part of the back side of the keyboard 4. In other words, the rib wall 12 extends from the bottom surface of the lower cover 22 into the lower cover 22 and toward the front of the lower cover 22. The right and left sides of the rib wall 12 extend nearly perpendicularly with respect to the bottom surface of the lower cover 22 and are connected to both the right and left sides of the open bottom edge of the opening section 11.

Inside the lower cover 22, as shown in FIGS. 2 to 4, is a partition wall 13 vertically extending from the bottom surface of the lower cover 22, in parallel with the front side 11A of the open bottom edge. The partition wall 13 is positioned at a specific distance, set nearly to the same length as that of the user's fingers, from the front side 11A, which had a convex shape, of the open bottom edge of the opening section 11 and extends to the vicinity of the back side of the keyboard 4. The partition wall 13 is bent to extend from a frontmost portion of partition wall 13, shown at the top of partition wall 13 as viewed in FIG. 4, toward the open edge of the opening section 11. That is, the partition wall 13 forms a U-shape at the front side of the lower cover 22, enclosing handle section 14, the rear edge of the rib wall 12, and a rear portion of opening section 11.

Furthermore, there is provided a handle section 14, in the cross-sectional form of a small circular arc, extending into the interior of the body, as shown in FIG. 2, at the front side 11A of the open bottom edge of the opening section 11. According to the present embodiment, as shown in FIG. 3, a lightening groove 14A is formed below handle section 14 from the back side in the handle. The lightening groove 14A not only saves material used in forming the lower cover 22, but also allows the carrying handle 10 to deflect when grasped, so as to provide a soft touch to the user's hand. The handle 14 is formed in a circular arc along the width of opening section 11, so that the arc of the handle 14 corresponds to the arc formed by the user's fingers. In other words, the center of curvature of the handle 14 corresponds to the center of curvature of the user's fingers. Therefore, when the carrying handle 10 is grasped, the circular, i.e., convex, surface of the handle 14 contacts all of the user's fingers, so that the weight of the typewriter 1 will be carried evenly by the user's four fingers instead of being concentrated at specific individual fingers. The typewriter, therefore, is easy to carry.

On the forward side of the opening section 11 provided in the lower cover 22 is formed an elliptical finger slot 16, which is depressed into the bottom of the lower cover 22. The finger slot 16 is arranged so that when the user grasps the carrying handle 10 with the right hand, the user's thumb will slide smoothly into the finger slot 16. With the user's thumb fixed in the finger slot 16, the handle can be grasped firmly, allowing the user easily to add force to better hold the typewriter 1.

The finger slot 16 also may be located in a position symmetrically opposite to the position shown in FIG. 3, so that the carrying handle 10 also may be firmly grasped by the user's left hand. Furthermore, the same effect is obtainable also by forming a horizontally elongated slot or step in the part of the lower cover 22 where the user's thumb will lie.

The opening section 11, the rib wall 12, the partition wall 13, the handle section 14 and the finger slot 16 all are formed of a resinous material and are formed integrally with the lower cover 22.

According to the above-described embodiment, a space is defined in the lower cover 22. The space is enclosed by the rib wall 12, the partition wall 13 and the reinforcing board 41 on the back of the keyboard switch base plate, and extends from the opening section 11 to the interior of the front part of the typewriter 1. Entry of dust and dirt into, and the contact of the user's fingers with, the electronic control circuitry in the typewriter is prevented.

According to embodiments of the present invention, the carrying handle 10 is designed to allow the user's fingers into the bottom surface of the body cover, because the opening section 11 is formed in the bottom surface. When the user inserts his fingers into the opening section 11, the finger tips will touch the rib wall 12 because the rib wall 12 extends from one side of the open edge of the opening section 11 to cover the opening section 11. The finger tips, after contacting the rib wall 12, are guided from the other side of the open edge to enter the front of the interior of the body cover. Moreover, because the partition wall 13 is provided in a position at a specific distance from the other side of the open edge, further movement of the user's fingers into the body is prevented.

The handle section 14 is provided on the other side of the open edge. The fingers, therefore, when inserted into the opening section 11 to carry the electronic typewriter, contact the handle section 14 along its circumferential surface. Because the handle section 14 is a small circular arc in cross-section, the handle section 14 prevents concentration of the load of the typewriter 1 at one point.

Carrying handle 10 according to the above-described embodiments preferably is composed of a single member. Therefore, the carrying handle 10 easily can be formed by using a pattern in the course of molding the lower cover 22. Since the carrying handle 10 is molded integrally with the typewriter body casing, no separate handle installation is required.

With recent advances in electronic circuit technology, the electronic control circuit and other major components occupying the interior of the body casing 2 have become smaller, thereby providing additional space. The carrying handle 10 according to the described embodiments uses this space in the body casing 2, and, therefore, does not require any additional mounting space and can be used with relatively small electronic devices. The rib wall 12, the partition wall 13 and the handle section 14 form recesses and projections in the body casing 2, imparting greater rigidity and resistance to twisting and torsion of the body casing 2.

The carrying handle 10 according to the described embodiments is located on the front side of the lower cover nearly at its central part, in the width-wise direction, and is below the keyboard 4. Generally, the electronic typewriter 1 is light in weight at the front side where the keyboard 4 is arranged, and is heavy at the rear side where the print head 8 and the platen 6 are mounted. Since the carrying handle 10 is located in the above-described position, the user, when moving the electronic typewriter 1 after use, easily can raise the light-weight front end of the typewriter by using the rear side of the lower cover 22 as a fulcrum, and thus easily can reach the carrying handle 10 with minimal effort merely by extending the hand slightly. Additionally, the lower the center of gravity of an object, the easier that object can be stably supported or carried. According to the present embodiments, when the user grasps the carrying handle 10 to carry the electronic typewriter 1, the heavy printing device is low while the lighter keyboard 4 is high. Thus, the center of gravity is low, allowing easy and stable transportation of the electronic typewriter.

It should be noted that the present invention is not limited to the embodiments described above. Many modifications are possible within the scope of the present invention. For example, in the above embodiments the carrying handle 10 has a hole in the lower cover 22 as shown in FIG. 2, but the hole may be closed by further extending the rib wall 12 forwardly to be formed integrally with the partition wall 13. Further, in the above embodiments, the handle section 14 extends into the interior of the body as shown in FIG. 2, but the handle section alternatively may extend outwardly from the exterior of the body.

While advantageous embodiments have been chosen to illustrate the invention, it will be understood by those skilled in the art that various changes and modifications can be made therein without departing from the scope of the invention.

What is claimed is:

1. A handle in an electronic device having a body cover for protection of interior components of the electronic device, the body cover having a top, a bottom, and a section extending between the top and bottom to enclose an interior of the body cover, the handle comprising:

an opening section provided in the bottom of the body cover, the opening section including a substantially rectangular opening having first and second longitudinal edges and first and second connecting edges extending between said first and second longitudinal edges;

a rib wall extending from the first longitudinal edge of the opening toward the interior of the body cover and toward but separated from said second longitudinal edge to partially enclose the opening section;

a partition wall extending from the bottom toward the interior of the body cover and having a longitudinal part separated from and aligned with the second longitudinal edge of the opening and a side part at each end of the longitudinal part respectively extending parallel to the first and second edges of the opening; and a handle section provided within the body cover along the second longitudinal edge of the opening, the second longitudinal edge having a convex curve with respect to the opening.

2. The carrying handle according to claim 1, wherein said handle section follows the convex curve over at least a mid-portion of the handle section.

3. The carrying handle according to claim 1, wherein said handle section includes a groove opening to an exterior surface of the bottom of the body cover.

4. The carrying handle according to claim 1, wherein the partition wall and an interior surface of the bottom form a finger-accommodating depression.

5. The carrying handle according to claim 1, wherein the partition wall extends vertically from the bottom toward the interior of the body cover.

6. The carrying handle according to claim 1, wherein sides of the rib wall extend toward and are joined with the side parts of the partition wall.

7. The carrying handle according to claim 1, wherein an exterior surface of the bottom of the body cover includes a substantially elliptical recessed finger slot offset from said handle section.

8. A handle for electronic equipment having a keyboard arranged in a body cover having a top, a bottom and sides between said top and bottom to define a cover interior and a printing device adjacent the keyboard, the handle comprising:

an opening section provided in the bottom of the body cover, substantially beneath the keyboard and having a first edge, a second edge opposing the first edge, a third edge between the first and second edges and a forth edge opposing the third edge and between the first and second edges, the first through forth edges defining an opening with the first and second edges longer than the third and forth edges;

a rib wall extending into the interior of the body cover from the bottom of the body cover and towards the keyboard, the rib wall extending from the second edge of the opening towards the interior of the body cover and toward the first edge to partially enclose the opening;

a partition wall extending from the bottom surface toward the interior of the body cover offset from the first edge of said opening; and a handle section provided along the first edge of said opening and extending into the body cover.

9. The carrying handle according to claim 8, wherein the handle section extends into the body cover in the form of a circular arc to engage the curve of human fingers.

10. The carrying handle according to claim 8, wherein the handle section is has a convex curve with respect to the opening and lying in the plane of the bottom of the body cover to correspond to the shape of a human hand.

11. The carrying handle according to claim 8, wherein the rib wall extends into the interior of the body cover in a curved shape.

12. The carrying handle according to claim 8, wherein the rib wall, the partition wall, and the handle section are formed of the same material.

13. The carrying handle according to claim 8, wherein the rib wall, the partition wall and the handle section are formed integrally as one piece with the body cover.

14. The carrying handle according to claim 8, wherein an interior space in the body cover is defined by a side of the keyboard, the rib wall and the partition wall.

15. The carrying handle according to claim 8, wherein an exterior surface of the bottom of the body cover includes a substantially elliptical recessed finger slot offset from the handle section.

16. The carrying handle according to claim 8, wherein sides of the rib wall extend toward and are joined with the partition wall.

17. The carrying handle according to claim 8, wherein the partition wall and an interior surface of the bottom form a finger-accommodating depression.

18. A handle in a device having a cover for protection of interior components of the device, the cover having a top, bottom and sides between the top and bottom to define a cover interior therebetween and the handle comprising:

an opening having a first and a second elongated edge and a first and a second connecting edge at ends of the first and second elongated edges in the bottom of the cover;

wall means extending from an interior surface of the bottom of the cover toward the interior of the cover for bordering the opening; and the first elongated edge having a substantially convex curve that forms a curved handle section means for contacting a user's hand.

* * * * *